US011292250B2

(12) United States Patent
Martin et al.

(10) Patent No.: US 11,292,250 B2
(45) Date of Patent: Apr. 5, 2022

(54) NON-NUCLEATION FLUID ACTUATOR MEASUREMENTS

(71) Applicant: Hewlett-Packard Development Company, L.P., Spring, TX (US)

(72) Inventors: Eric Martin, Corvallis, OR (US); Tsuyoshi Yamashita, Corvallis, OR (US); James R. Przybyla, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/965,703

(22) PCT Filed: Mar. 12, 2018

(86) PCT No.: PCT/US2018/021990
§ 371 (c)(1),
(2) Date: Jul. 29, 2020

(87) PCT Pub. No.: WO2019/177568
PCT Pub. Date: Sep. 19, 2019

(65) Prior Publication Data

US 2021/0039383 A1 Feb. 11, 2021

(51) Int. Cl.
*B41J 2/045* (2006.01)
*B41J 2/14* (2006.01)

(52) U.S. Cl.
CPC ..... *B41J 2/0458* (2013.01); *B41J 2/04543* (2013.01); *B41J 2/04555* (2013.01); *B41J 2002/14354* (2013.01)

(58) Field of Classification Search
CPC ... B41J 2/0458; B41J 2/04543; B41J 2/04555
See application file for complete search history.

(56) References Cited

U.S. PATENT DOCUMENTS 6,565,177 B1 * 5/2003 Corrigan, III ..... B41J 2/04528 19/17
7,150,513 B2 12/2006 Shinkawa et al.
(Continued)

FOREIGN PATENT DOCUMENTS

JP 2004-306529 A 11/2004
JP 2009-012458 A 1/2009
JP 2009-248532 A 10/2009

*Primary Examiner* — Jason S Uhlenhake
(74) *Attorney, Agent, or Firm* — Fabian VanCott

(57) ABSTRACT

In one example in accordance with the present disclosure, a fluidic die is described. The fluidic die includes an array of fluid actuators grouped into primitives. Each actuator is disposed in a fluid chamber. The fluidic die also includes an array of fluid sensors. Each fluid sensor is disposed within a fluid chamber and determines a characteristic within the fluid chamber. A data parser of the fluidic die extracts from an incoming signal, firing instructions and measurement instructions for the fluidic die. The measurement instructions indicate at least one of a peak measurement during a nucleation event and a reference measurement during a non-nucleation event. A firing controller generates firing signals based on the firing instructions and a measurement controller activates, during a measurement interval of a printing cycle for the primitive, a measurement for a selected actuator based on the measurement instructions.

20 Claims, 7 Drawing Sheets

(56) References Cited

U.S. PATENT DOCUMENTS

| | | | | |
|---|---|---|---|---|
| 7,429,093 | B2 | 9/2008 | Shinkawa | |
| 8,585,175 | B2 | 11/2013 | Hayashi | |
| 9,340,048 | B2 | 5/2016 | Ready et al. | |
| 2013/0148989 | A1* | 6/2013 | Silcoff | B41J 2/175 399/38 |
| 2016/0377567 | A1 | 12/2016 | Lu et al. | |
| 2017/0087853 | A1 | 3/2017 | Khalate et al. | |
| 2018/0009224 | A1 | 1/2018 | Ge et al. | |

* cited by examiner

NON-NUCLEATION FLUID ACTUATOR MEASUREMENTS

BACKGROUND

A fluidic die is a component of a fluidic system. The fluidic die includes components that manipulate fluid flowing through the system. For example, a fluidic ejection die, which is an example of a fluidic die, includes a number of nozzles that eject fluid onto a surface. The fluidic die also includes non-ejecting actuators such as micro-recirculation pumps that move fluid through the fluidic die. Through these nozzles and pumps, fluid, such as ink and fusing agent among others, is ejected or moved. Over time, these nozzles and pumps can become clogged or otherwise inoperable. As a specific example, ink in a printing device can, over time, harden and crust. This can block the nozzle and interrupt the operation of subsequent ejection events. Other examples of issues affecting these actuators include fluid fusing on an ejecting element, particle contamination, surface puddling, and surface damage to die structures. These and other scenarios may adversely affect operations of the device in which the fluidic die is installed.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
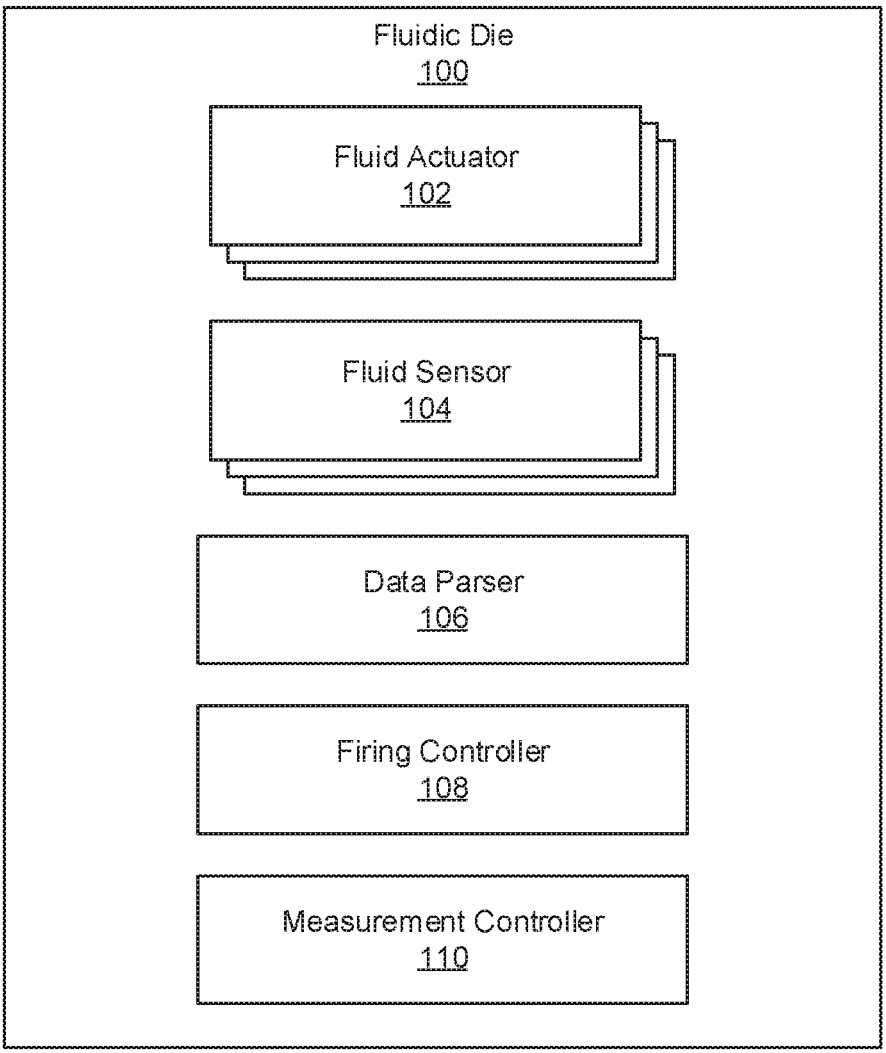
FIG. 1 is a block diagram of a fluidic die for performing fluid analysis with non-nucleation measurements, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Fluidic dies, as used herein, may describe a variety of types of integrated devices with which small volumes of fluid may be pumped, mixed, analyzed, ejected, etc. Such fluidic dies may include ejection dies, such as printheads, additive manufacturing distributor components, digital titration components, and/or other such devices with which volumes of fluid may be selectively and controllably ejected. Other examples of fluidic dies include fluid sensor devices, lab-on-a-chip devices, and/or other such devices in which fluids may be analyzed and/or processed.

In a specific example, these fluidic systems are found in any number of printing devices such as inkjet printers, multi-function printers (MFPs), and additive manufacturing apparatuses. The fluidic systems in these devices are used for precisely, and rapidly, dispensing small quantities of fluid. For example, in an additive manufacturing apparatus, the fluid ejection system dispenses fusing agent. The fusing agent is deposited on a build material, which fusing agent facilitates the hardening of build material to form a three-dimensional product.

Other fluid ejection systems dispense ink on a two-dimensional print medium such as paper. For example, during inkjet printing, fluid is directed to a fluid ejection die. Depending on the content to be printed, the device in which the fluid ejection system is disposed determines the time and position at which the ink drops are to be released/ejected onto the print medium. In this way, the fluid ejection die releases multiple ink drops over a predefined area to produce a representation of the image content to be printed. Besides paper, other forms of print media may also be used.

Accordingly, as has been described, the systems and methods described herein may be implemented in a two-dimensional printing, i.e., depositing fluid on a substrate, and in three-dimensional printing, i.e., depositing a fusing agent or other functional agent on a material base to form a three-dimensional printed product.

Returning to the fluid actuators, a fluid actuator may be disposed in a nozzle, where the nozzle includes a fluid chamber and a nozzle orifice in addition to the fluid actuator. The fluid actuator in this case may be referred to as an ejector that, upon actuation, causes ejection of a fluid drop via the nozzle orifice.

Fluid actuators may also be pumps. For example, some fluidic dies include microfluidic channels. A microfluidic channel is a channel of sufficiently small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.). Fluidic actuators may be disposed within these channels which, upon activation, may generate fluid displacement in the microfluidic channel.

Examples of fluid actuators include a piezoelectric membrane based actuator, a thermal resistor based actuator, an electrostatic membrane actuator, a mechanical/impact driven membrane actuator, a magneto-strictive drive actuator, or other such elements that may cause displacement of fluid responsive to electrical actuation. A fluidic die may include a plurality of fluid actuators, which may be referred to as an array of fluid actuators.

The array of fluid actuators may be formed into groups referred to as "primitives." A primitive generally includes a group of fluid actuators that each have a unique actuation address. In some examples, electrical and fluidic constraints of a fluidic die may limit which fluid actuators of each primitive may be actuated concurrently for a given actuation event. Therefore, primitives facilitate addressing and subsequent actuation of fluid ejector subsets that may be concurrently actuated for a given actuation event.

A number of fluid ejectors corresponding to a respective primitive may be referred to as a size of the primitive. To illustrate by way of example, if a fluidic die has four primitives and each respective primitive has eight respective fluid actuators (the different fluid actuators having an address 0 to 7), the primitive size is eight. In this example, each fluid actuator within a primitive has a unique in-primitive address. In some examples, electrical and fluidic constraints limit actuation to one fluid actuator per primitive. Accordingly, a total of four fluid actuators (one from each primitive) may be concurrently actuated for a given actuation event. For example, for a first actuation event, the respective fluid actuator of each primitive having an address of 0 may be actuated. For a second actuation event, the respective fluid actuator of each primitive having an address of 1 may be actuated. In some examples, the primitive size may be fixed and in other examples the primitive size may vary, for example after the completion of a set of actuation events.

While such fluidic systems and dies undoubtedly have advanced the field of precise fluid delivery, some conditions impact their effectiveness. For example, the fluid actuators on a fluidic die are subject to many cycles of heating, drive bubble formation, drive bubble collapse, and fluid replenishment from a fluid reservoir. Over time, and depending on other operating conditions, the fluid actuators may become blocked or otherwise defective. For example, particulate matter, such as dried ink or powder build material, can block the opening. This particulate matter can adversely affect the formation and release of subsequent fluid. Other examples of scenarios that may impact the operation include a fusing of the fluid on the actuator element, surface puddling, and general damage to components within the fluid chamber. As the process of depositing fluid on a surface, or moving a fluid through a fluidic die is a precise operation, these blockages can have a deleterious effect on print quality or other operation of the system in which the fluidic die is disposed. If one of these actuators fails, and is continually operating following failure, then it may cause neighboring actuators to fail.

Accordingly, the present specification is directed to determining a state of a particular fluid actuator and/or identifying when a fluid actuator is blocked or otherwise malfunctioning. Following such an identification, appropriate measures such as actuator servicing and actuator replacement can be performed.

To perform such identification, a fluidic die of the present specification includes a number of fluid sensors disposed on the fluidic die itself, which fluid sensors are paired with fluid actuators. In one example, the fluid sensors generate a voltage that is reflective of the state of the fluid. From the state of the fluid in a fluid chamber, an evaluator device can evaluate the fluid actuator to determine whether it is functioning as expected or not. In another example, multiple output voltages, taken at different times, can be evaluated in aggregate to as to produce a voltage profile. The voltage profile can be evaluated to determine functionality of the fluid actuator.

In some examples, the multiple measurements that generate the multiple output voltages include 1) a "peak measurement" taken during a time when a drive bubble is expected to be at its maximum volume and 2) a "reference measurement" taken during a time when the fluid chamber is full of fluid. In some cases, this reference measurement was taken following a nucleation event wherein a drive bubble was formed and has collapsed and the fluid chamber has subsequently refilled with fluid. Waiting until the chamber has refilled to take the reference measurement means that the maximum printing speed is reduced as printing cannot resume until after these measurements are taken.

Accordingly, the present specification describes a fluidic die and method wherein the reference measurement is taken during a non-nucleation event, rather than after a nucleation event. That is the reference measurement can be taken at an earlier point in time, thus reducing the delay for resuming printing.

Moreover, in some cases, a single non-nucleation measurement is taken and the actuator state determined therefrom. In this example, as no nucleation event is triggered during measurement, the reference measurement can be taken at an earlier period of time, thus further increasing the maximum possible printing speed for a particular printing system.

Specifically, the present specification describes a fluidic die. The fluidic die includes an array of fluid actuators grouped into primitives. Each fluid actuator is disposed in a fluid chamber. The fluidic die also includes an array of fluid sensors. Each fluid sensor is disposed within a fluid chamber to determine a characteristic within the fluid chamber. A data parser on the fluidic die extracts, from an incoming signal, firing instructions and measurement instructions for the fluidic die. The measurement instructions indicate at least one of a peak measurement during a nucleation event and reference measurement during a non-nucleation event. A firing controller on the fluidic die generates firing signals based on the firing instructions and a measurement controller activates, during a measurement interval of a printing cycle for the primitive, a measurement for a selected actuator based on the measurement instructions.

In another example, the fluidic die includes an array of fluid actuators grouped into primitives, each actuator being disposed in a fluid chamber. In this example, the fluidic die includes an array of impedance sensors. Each impedance sensor is disposed within a fluid chamber to determine an impedance within the fluid chamber. The fluidic die includes the data parser, firing controller, and measurement controller. In this example, the measurement controller, for a two-step measurement, activates a first impedance measurement for a selected actuator at a predetermined time within a measurement interval of a first printing cycle for the primitive. The first impedance measurement follows a nucleation event. Still for a two-step measurement, the measurement controller activates a second impedance measurement for the selected actuator at the predetermined time within a measurement interval of a second printing cycle for the primitive. The second impedance measurement follows a non-nucleation event. By comparison, for a one-step measurement, the measurement controller activates a single impedance measurement for the selected actuator within the measurement interval of the first printing cycle for the primitive. The one-step impedance measurement immediately follows a non-nucleation event.

The present specification also describes a method. According to the method, a determination is made as to which of a two-step measurement and a one-step measurement to execute. For a two-measurement a first measurement is activated for a selected actuator at a predetermined time within a measurement interval of a first printing cycle for the primitive. Next a second measurement for the selected actuator is activated at the predetermined time within a measurement interval of a second printing cycle for the primitive. During the two-step measurement, the first measurement follows a nucleation event and the second measurement follows a non-nucleation event. For a one-step measurement, a single measurement for the selected actuator is activated within the measurement interval of the first printing cycle for the primitive. In a one-step measurement, the measurement immediately follows a non-nucleation event. In either case, a state of the selected actuator is determined based on a profile that includes the respective measurements.

In one example, using such a fluidic die 1) allows for actuator evaluation; 2) increases printing speed when actuator measurements are inserted into a printing cycle: 3) reduces the constraints imposed on measurement intervals and actuation intervals within a printing cycle thus improving image quality; and 4) reduces the number of unwanted fluidic ejection events thus conserving fluid.

As used in the present specification and in the appended claims, the term "actuator" refers an actuating ejector and a non-ejecting actuator. For example, an ejector, which is an actuator, operates to eject fluid from the fluid ejection die. A recirculation pump, which is an example of a non-ejecting actuator, moves fluid through the fluid slots, channels, and pathways within the fluid die. Other types of non-ejecting actuators are also possible. For example, a non-ejecting actuator may generate a steam bubble wherein the dynamics of the formation and collapse of the steam bubble can be analyzed to determine fluid properties.

Accordingly, as used in the present specification and in the appended claims, the term "nozzle" refers to an individual component of a fluid ejection die that dispenses fluid onto a surface. The nozzle includes at least an ejection chamber, an ejector actuator, and an opening.

Further, as used in the present specification and in the appended claims, the term "fluidic die" refers to a component of a fluid system that includes components for storing, moving, and/or ejecting fluid. A fluidic die includes fluidic ejection dies and non-ejecting fluidic dies.

Still further, as used in the present specification and in the appended claims, the term "fluid sensor" refers to a sensor that determines a characteristic within a fluid chamber. An impedance sensor is one type of fluid sensor that measures, or determines, an impedance within a fluid chamber. In one specific example, a resistance sensor is one type of impedance sensor that detects characteristics of a DC signal. In other examples, other signals such as a precise current for a precise time is forced onto the sensor.

Still further, as used in the present specification and in the appended claims, the term "nucleation event" refers to an instance when actuation of a fluid actuator results in the formation of a drive bubble.

By comparison, the term "non-nucleation event" refers to an instance when an actuation of a fluid actuator, or a non-actuation of a fluid actuator occurs such that no drive bubble is formed.

Still further, as used in the present specification and in the appended claims, the term "printing cycle" refers to a period of time that includes 1) actuation intervals for each fluid actuator within a primitive and 2) a measurement interval. The actuation intervals referring to a window set apart for a particular fluid actuator, during which that particular fluid actuator may or may not be fired. For example, each fluid actuator in a primitive has a dedicated actuation interval wherein if that fluid actuator is to be actuated it will be. The measurement interval refers to a window set apart for a fluid actuator to be measured for health.

Lastly, as used in the present specification and in the appended claims, the term "a number of" or similar language is meant to be understood broadly as any positive number including 1 to infinity.

Turning now to the figures, FIG. 1 is a block diagram of a fluidic die (100) for performing fluid analysis with non-nucleation measurements, according to an example of the principles described herein. As described above, the fluidic die (100) is part of a fluid system that houses components for ejecting fluid and/or transporting fluid along various pathways. The fluid that is ejected and moved throughout the fluidic die (100) can be of various types including ink, biochemical agents, and/or fusing agents. The fluid is moved and/or ejected via an array of fluid actuators (102). Any number of fluid actuators (102) may be formed on the fluidic die (100).

The fluid actuators (102) may be of varying types. For example, the fluidic die (100) may include an array of nozzles, wherein each nozzle includes a fluid actuator (102) that is an ejector. In this example, a fluid ejector, when activated, ejects a drop of fluid through a nozzle orifice of the nozzle.

Another type of fluid actuator (102) is a recirculation pump that moves fluid between a nozzle channel and a fluid slot that feeds the nozzle channel. In this example, the fluidic die includes an array of microfluidic channels. Each microfluidic channel includes a fluid actuator (102) that is a fluid pump. In this example, the fluid pump, when activated, displaces fluid within the microfluidic channel. While the present specification may make reference to particular types of fluid actuators (102), the fluidic die (100) may include any number and type of fluid actuators (102).

The fluid actuators (102) are grouped into primitives. As described above, a primitive refers to a grouping of fluid actuators (102) where each fluid actuator (102) within the primitive has a unique address. For example, within a first primitive, a first fluid actuator (102) has an address of 0, a second fluid actuator (104) has an address of 1, a third fluid actuator (102) has an address of 2, and a fourth fluid actuator (102) of the primitive has an address of 3. The fluid actuators (102) that are grouped into subsequent primitives respectively have similar addressing. A fluidic die (100) may include any number of primitives having any number of fluid actuators (102) disposed therein.

The fluidic die (100) also includes a number of fluid sensors (104) disposed on the fluidic die (100). In some cases, the fluid sensors (104) are disposed within the fluid chambers. The fluid sensors (104) sense a characteristic of a corresponding fluid actuator (102). For example, the fluid sensors (104) may be impedance sensors that measure an impedance within a fluid chamber. The impedance of a fluid refers to that fluid's opposition to alternating and/or direct current. Impedance can be measured by applying an electrical stimulus, i.e., a voltage or a current, to a sensor in contact with the fluid, and measuring a corresponding output, i.e., current or voltage. A resistance sensor is one particular type of impedance sensor that detects characteristics of a DC signal.

In a specific example, the fluid sensors (104) are drive bubble detectors that measure characteristics of a drive bubble within a fluid chamber. In this example, a drive bubble is generated by a fluid actuator (102). The drive bubble moves fluid in, or ejects fluid from, the fluid chamber. Specifically, in thermal inkjet printing, a thermal ejector heats up to vaporize a portion of fluid in a fluid chamber. As the bubble expands, it forces fluid out of the fluid chamber. As the bubble collapses, a negative pressure within the fluid chamber draws fluid from the fluid source, such as a fluid feed slot or fluid feed holes, to the fluidic die (100). Sensing the proper formation and collapse of such a drive bubble can be used to evaluate whether a particular fluid actuator (102)

is operating as expected. That is, a blockage in the fluid chamber will affect the formation and/or collapse of the drive bubble. If a drive bubble has not formed as expected or if it has not collapsed as expected, it can be determined that the nozzle is blocked and/or not working in the intended manner.

The characteristics of a drive bubble can be detected by measuring impedance values within the fluid chamber. That is, as the vapor that makes up the drive bubble has a different conductivity than the fluid that otherwise is disposed within the chamber, when a drive bubble exists in the ejection chamber, a different impedance value will be measured. Accordingly, a drive bubble detection device measures this impedance and outputs a corresponding voltage. As will be described below, this output can be used to determine whether a drive bubble is properly forming and therefore determine whether the corresponding ejector or pump is in a functioning or malfunctioning state.

In some cases multiple impedance measurements can be combined into a profile. Such measurements can be of different types. For example, during a nucleation event, a fluid actuator (102) is actuated and a "peak measurement" is taken at a time when it is expected that mostly vapor fills the fluid chamber. By comparison, a "reference measurement" is taken at a time when it is expected that mostly fluid fills the fluid chamber. These two measurements together form a profile from which actuator health can be determined. That is, in one example, the difference between the two voltages is determined. If the difference between the two voltage is within a specified range, then the fluid actuator (102) is considered functional. If the difference is below the threshold, the fluid actuator (102) is considered compromised.

In addition to looking at measurement differences, the raw impedances can be measured at each point in time. With raw values of the measurements, and the differences between the measurements, signature is determined from which users can infer characteristics of actuator functionality.

Previously such reference measurements were taken following a nucleation event, which could result in a delay. However, according to the present specification such reference measurements are taken during a non-nucleation event such as when a fluid actuator (102) is either 1) not actuated or 2) actuated such that no nucleation results.

Taking reference measurements during non-nucleation events may result in increased printer performance. For example, a peak measurement was taken during a measurement interval which included a nucleation event. During a measurement interval of a different print cycle, a reference measurement was taken after the nucleation event. However, the measurement interval for both printing cycles is defined by the amount of time to take the reference measurement. Thus, even though a peak measurement could be made faster, the printing cycle itself is longer than it otherwise would be as the measurement interval has to be long enough to allow for the longer reference measurement.

Accordingly, by taking reference measurements during a non-nucleation event, there is no longer a need to wait until drive bubble collapse. That is the measurement interval in the present specification is defined not by the refill time following a nucleation event, but is defined by the peak measurement during a nucleation event.

In other examples, a peak measurement is not taken at all and actuator status is determined based solely on a reference measurement. In this example, the measurement interval is no longer defined by the peak measurement, but the time it takes to make a reference measurement.

Specific examples of the timing of such one-step, non-nucleation reference measurements, and two-step, non-nucleation and nucleation measurements, is presented below in connection with FIGS. 3, 5, and 6.

Returning to the fluidic die (100), the fluidic die (100) also includes a data parser (106). The data parser (106) receives an incoming signal and extracts any firing instructions and/or measurement instructions contained therein. That is, a fluidic die (100) has an input that receives packets of information. The packets of information dictate which, if any, fluid actuators (102) should fire, and includes the information to effectuate such firings. The packets of information also indicate whether fluid actuators (102) are to be evaluated and which fluid actuators (102) are to be evaluated. The data parser (106) receives this signal and extracts the firing instructions and the measurement instructions. Specifically, the measurement instructions indicate whether, for a particular printing cycle, a non-nucleation reference measurement or a nucleation peak measurement should be executed.

The firing controller (108) of the fluidic die (100) then effectuates fluid actuation based on the firing instructions. Similarly, the measurement controller (110) activates, during a measurement interval of a printing cycle for the primitive, a measurement for a selected actuator (102) based on these measurement instructions. For example, if the measurement instructions indicate a particular fluid actuator (102) is to be tested, and that such a test includes just a non-nucleation reference measurement, the measurement controller (110) would activate the respective fluid sensor (104) and also, the firing controller (108) may suppress firing of the selected fluid actuator (102).

Such a fluidic measurement system improves print speed. For example, as described above, rather than waiting until after a drive bubble has collapsed to take a reference measurement, the present system takes a reference measurement without relying on, or waiting for, a nucleation event. Doing so provides a reference measurement from which fluid actuator (102) state is determined, without waiting for the drive bubble to collapse.

Moreover, by taking just a non-nucleation reference measurement, the time is even further reduced. That is, while a peak measurement takes less time than a reference measurement following a nucleation event due to not having to wait until the drive bubble collapses, the peak measurement is still delayed. For example, a period of time exists before the peak is reached and a certain amount of delay is incorporated before the peak measurement is made. Such a delay may result from data loading, fire pulse propagation, measurement wait time, voltage sampling, and the time between applying energy to the fluid actuator (102) and the drive bubble forming. Accordingly, by taking a measurement without having to wait for the peak period, the measurement interval is thus further reduced.

Reducing the measurement interval can increase print speeds. It also may allow for the actuation intervals of the printing cycle to be lengthened. That is, due to the lengthy reference-based measurement interval, the actuation intervals are restricted to a certain length to maintain a desired printing cycle length. This restriction of the actuation interval length can negatively impact printing.

Accordingly, in the present specification, the measurement interval is shortened by not waiting for completion of the nucleation event to take a reference measurement and 2) in some cases not taking a peak measurement. Accordingly, the length of the overall printing cycle may be reduced in length, or maintained in length with the actuation intervals lengthened. Decreasing the printing cycle length may improve printing speed while lengthening the actuation intervals may increase the print quality.

Still further, the present system reduces the quantity of visible artifacts of the measurement operation. That is, in taking a nucleation-based peak measurement and a nucleation-based reference measurement, two nucleation events were performed, each of which result in a drop on the substrate, perhaps at an unwanted location. Accordingly by taking a reference measurement following a non-nucleation event, one nucleation event is avoided such that the number of unwanted drops of fluid is reduced, thus improving image quality.

Figure 2:
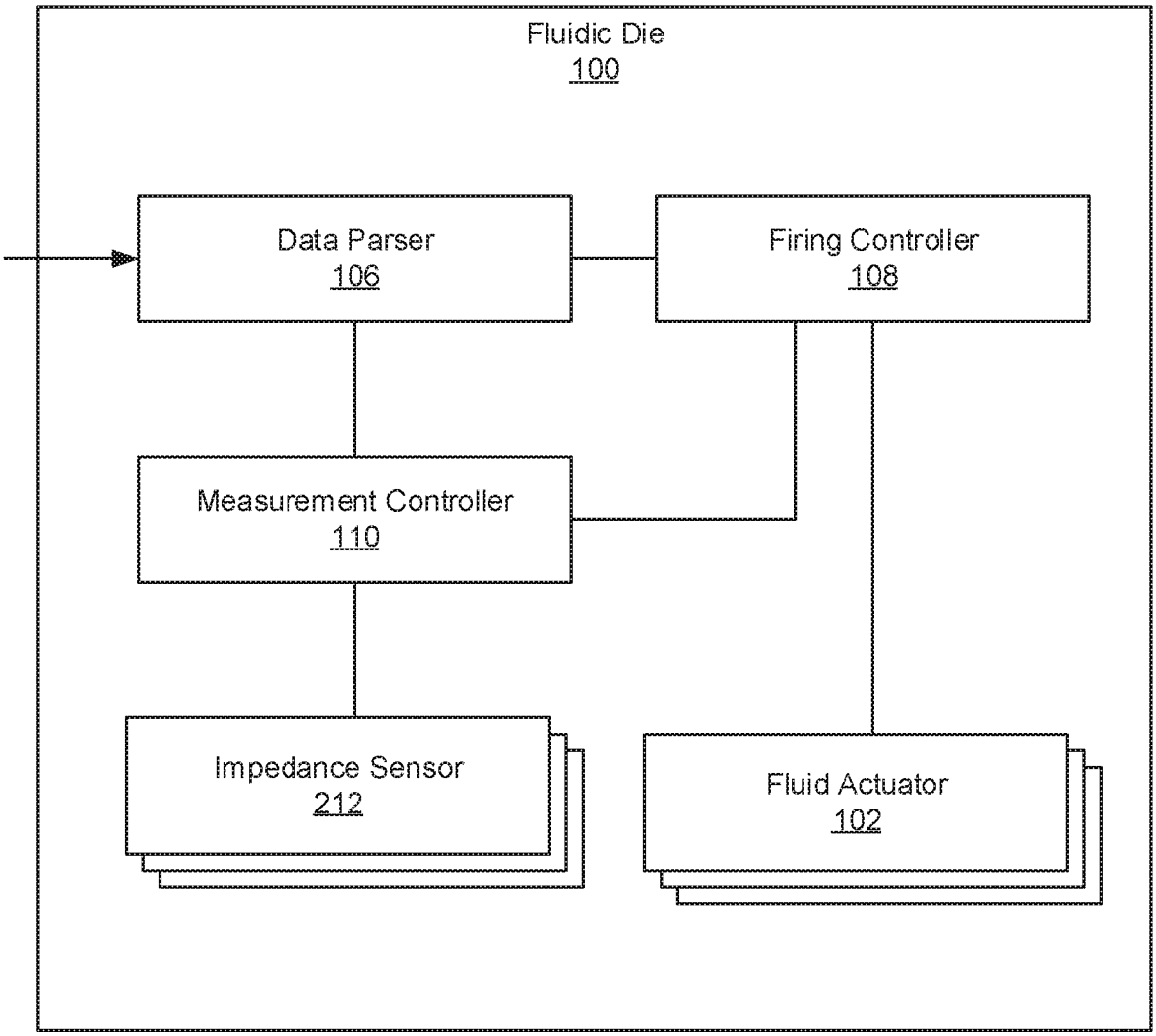
FIG. 2 is a diagram of a fluidic die for performing fluid analysis with non-nucleation measurements, according to an example of the principles described herein.

FIG. 2 is a block diagram of a fluidic die (100) for performing fluid analysis with non-nucleation measurements, according to an example of the principles described herein. Specifically, FIG. 2 depicts an example where the fluid sensors (FIG. 1, 104) are impedance sensors (212) that measure an impedance within a fluid chamber.

FIG. 2 also depicts a data path for an incoming signal. That is, as described above, the data parser (106) receives an incoming signal. The incoming signal includes bits that indicate operating parameters for the impedance sensors (212) and the fluid actuators (102). The data parser (106) parses the incoming signal to extract firing instructions for the firing controller (108) and measurement instructions for the measurement controller (110). The firing instructions passed to the firing controller (108) may indicate whether and which set of fluid actuators (102) to actuate. The firing instructions passed to the firing controller (108) may also indicate whether, during a measurement interval, a selected fluid actuator (102) is to actuate. For example, if the measurement instructions indicate a peak measurement, then the parsed firing instructions may indicate that during the measurement interval, the selected fluid actuator (102) is to actuate. Accordingly, the firing controller (108) may pass a nucleation activation signal to generate the nucleation event.

By comparison, if the measurement instructions indicate a reference measurement, then the parsed firing instructions may include either 1) a non-nucleation activation signal which provides insufficient energy to generate a nucleation event or 2) a suppression signal which suppresses an activation signal during the non-nucleation event. Accordingly, the firing controller (108) may pass a non-nucleation activation signal to generate or suppress a received activation signal.

The measurement instructions passed to the measurement controller (110) may indicate whether, during a measurement interval, whether to actuate a particular impedance sensor (212). For example, if the measurement instructions indicate a measurement of a particular fluid actuator (102), then the parsed measurement instructions may indicate a corresponding impedance sensor (212). Accordingly, the measurement controller (108) may pass an impedance sensor (212) activation signal. As the measurements follow fluid actuator (102) activation, the measurement controller (110) may also receive a signal from the firing controller (108) such that the measurement is timed to fluidic actuation.

Figure 3:
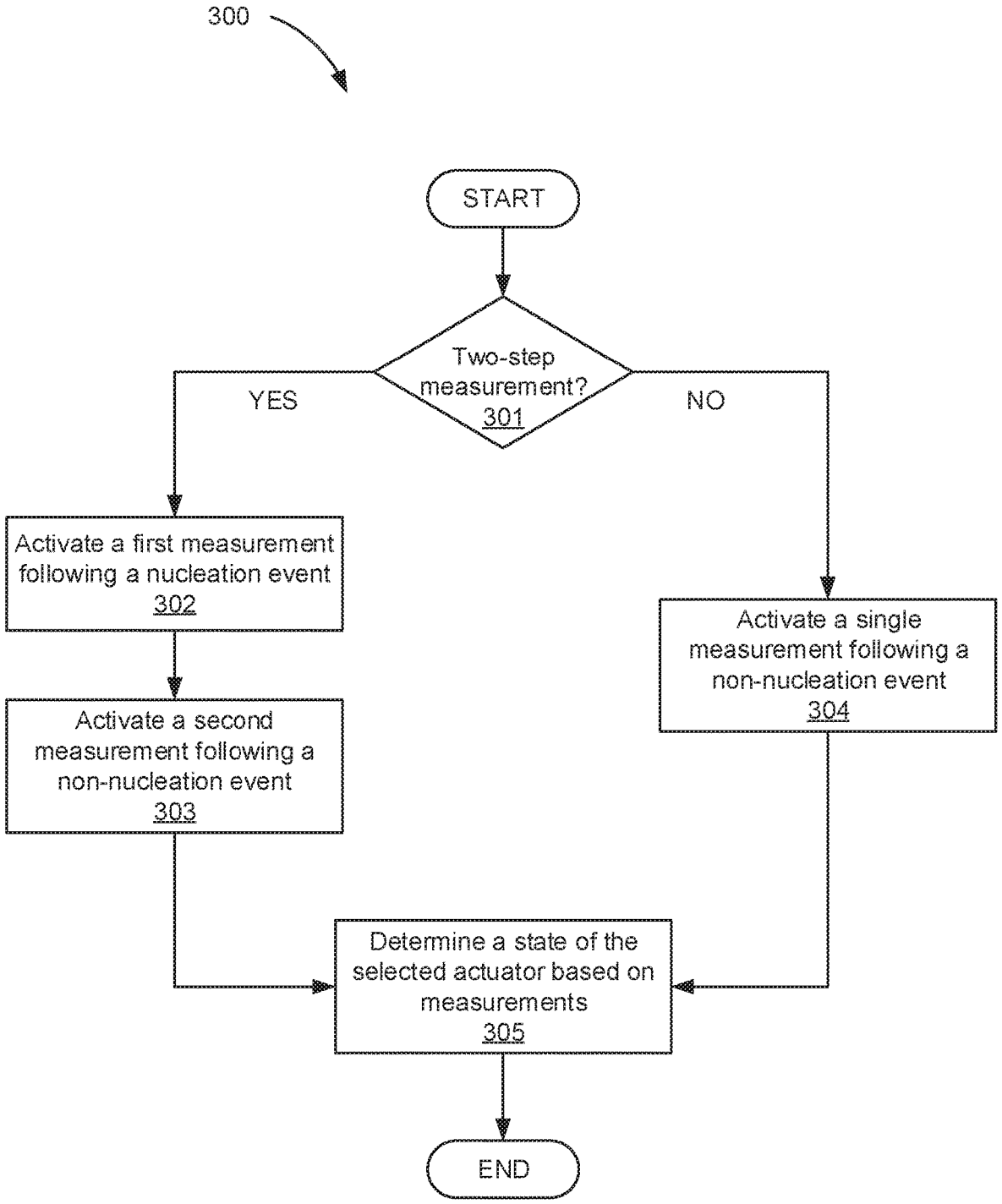
FIG. 3 is a flow chart of a method for performing fluid analysis with non-nucleation measurements, according to an example of the principles described herein.

FIG. 3 is a flow chart of a method (300) for performing fluid analysis with non-nucleation measurements, according to an example of the principles described herein. According to the method (300), it is first determined (block 301) which of a two-step measurement and a one-step measurement is to be executed. A two-step measurement refers to a measurement operation wherein two measurements are taken, and a profile created therefrom which profile is used to evaluate a fluid actuator (FIG. 1, 102) state. In this example, the two measurements include a peak measurement during a nucleation event and a reference measurement during a non-nucleation event. By comparison, a one-step measurement refers to a measurement operation wherein a single measurement is taken which is used to evaluate a fluid actuator (FIG. 1, 102) state. In this example, the single measurement includes a reference measurement during a non-nucleation event.

If it is determined that a two-step measurement is to be executed (block 301, determination YES), a first measurement for a selected actuator is activated (block 302). As described above, such a measurement is performed during a nucleation event. Accordingly, in this example, the incoming signal indicates 1) a nucleation peak measurement and a nucleation activation signal. This first measurement occurs at a predetermined time, X, within a measurement interval of a first printing cycle. That is, the measurement interval is a portion of a printing cycle dedicated for taking a measurement. Within that measurement interval, a predetermined time, X, is determined to initiate measurement sampling. The predetermined time, X, may account for a delay, fire pulse propagation, and a time need for the drive bubble to teach its expected max volume.

Then during a second printing cycle, a second measurement is activated (block 303), which occurs during a non-nucleation event. Accordingly, in this example, the incoming signal for the second printing cycle indicates 1) a non-nucleation reference measurement and 2) a non-nucleation activation signal. The second measurement is activated at the same predetermined time, X, within the measurement interval, as when the first measurement was initiated. That is, within the measurement interval for the first printing cycle, a measurement sample, e.g., a peak measurement, is taken at time X within the respective measurement interval. Accordingly, in the measurement interval for the second printing cycle, a measurement sample, this time a reference measurement, is taken at time X within the respective measurement interval. In other words, for a two-step measurement, the measurement interval length for all printing cycles is defined by the predetermined time X needed to execute a peak measurement. This results in a decrease in overall printing length as with a reference measurement taken following a nucleation event, the measurement interval for all printing cycles was based on the length of time, Y, needed to execute a reference measurement following bubble collapse, which time Y is greater than X.

In summary, during one print cycle of a two-step measurement, 1) the measurement instructions indicate a nucleation peak measurement, 2) the firing instructions indicate a nucleation event for the measurement interval, and 3) the measurement controller (FIG. 1, 110) activates a first measurement for the selected actuator (FIG. 1, 102) at a predetermined time within the measurement interval following the nucleation event. During another printing cycle of the two-step measurement, 1) the measurement instructions indicate a non-nucleation reference measurement, 2) the firing instructions indicate a non-nucleation event for the measurement interval, and 3) the measurement controller (FIG. 1, 110) activates a second measurement for the selected actuator (FIG. 1, 102) at a predetermined time within the measurement interval following the non-nucleation event.

While FIG. 3 depicts one measurement, a nucleation peak measurement, occurring before a non-nucleation reference measurement, these could be performed in other orders, for example, a non-nucleation reference measurement could be made in the measurement interval of the first printing cycle and a nucleation peak measurement could be made in the measurement interval of the second printing cycle.

Such a two-step measurement provides for an identification of a wide variety of actuator conditions. For example, as will be described below a difference between the peak measurement and reference measurement can be compared to a difference threshold. Based on the comparison between the peak-to-reference differences against the difference threshold a certain type of actuator defect, such as a blocked inlet, may be detected. Still further by comparing just one of the peak measurement or reference measurement, and not a difference therebetween, against thresholds, additional types of defects may be detected, such as blocked bores.

If it is determined that a one-step measurement is to be executed (block 301, determination NO), a single measurement for a selected fluid actuator (FIG. 1, 102) is activated (block 304). This single measurement occurs during a non-nucleation event. Accordingly, in this example, the incoming signal for the printing cycle indicates 1) a non-nucleation reference measurement and 2) a non-nucleation activation signal.

In this example, the single measurement may be taken at any time within the measurement interval. That is, there is no predetermined time, X, before which an impedance measure cannot be taken. Put another way, the reference measurement in a non-nucleation measurement can be taken at any time. In other words, for a one-step measurement, the measurement interval length for all printing cycles is not defined by the predetermined time X needed to execute a peak measurement. This results in a decrease in overall printing length as with a reference measurement taken based on a peak measurement-based measurement interval, the measurement interval for all printing cycles was based on the length of time, X, needed to execute a peak measurement when a greatest impedance within the fluid chamber is expected. As no peak measurement is made during a one-step measurement, no such length of time, X, defines the measurement interval.

In summary, during one print cycle, 1) the measurement instructions indicate a non-nucleation peak measurement, 2) the firing instructions indicate a non-nucleation event for the measurement interval, and 3) the measurement controller (FIG. 1, 110) activates a first measurement for the selected actuator (FIG. 1, 102) at a predetermined time within the measurement interval following the non-nucleation event.

Such a one-step measurement while maybe providing indicia of fewer types of defects on account of not having the peak measurement to compare against a threshold, provides a quicker measurement, and therefore provides for even quicker printing speeds. In other words, the determination (block 301) as to whether a two-step or one-step measurement occurs may be based on a cycle of the fluidic die (FIG. 1, 100) or the system in which the fluidic die (FIG. 1, 100) is inserted. For example, during a print swath when fluid actuators (FIG. 1, 102) are actively dispensing fluid; a one-step measurement may be desired, but then in between print swaths or during other idle times, there may be sufficient time to execute a lengthier, but more comprehensive, two-step measurement. In other words, the determination as to which of a two-step measurement and a one-step measurement may be based on the activity of the fluidic die (FIG. 1, 100) with a one-step measurement being executed during periods of greater activity and a two-step measurement being executed during periods of lesser activity. Note that while FIG. 3 depicts a two-step measurement system, additional measurements may be taken to create a higher resolution profile from which additional characteristics of the fluid actuators (FIG. 1, 102) may be determined.

In either case, following the measurement, a state of the selected fluid actuator (FIG. 1, 102) is then determined (block 305) based on a comparison of the voltages with the corresponding threshold. That is a profile for the selected actuator (FIG. 1, 102) may be formed, which profile includes the measurements taken, be it one measurement or two. This profile is compared against a threshold profile to determine a state of the selected fluid actuator (FIG. 1, 102).

Figure 4:
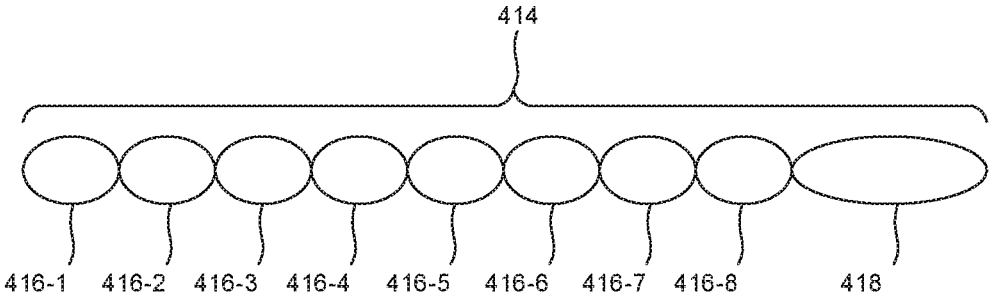
FIG. 4 is a diagram of a printing cycle, according to another example of the principles described herein.

FIG. 4 is a diagram of intervals within one printing cycle (414), according to another example of the principles described herein. As described above, a printing cycle (414) includes actuation intervals (416) for each fluid actuator (FIG. 1, 102) within a primitive as well as a measurement interval (418). That is, each printing cycle (414) pertains to an individual primitive. Accordingly, the primitive to which the printing cycle (414) depicted in FIG. 4 corresponds includes eight fluid actuators (FIG. 1, 102) per primitive. Each actuation interval (416) refers to a window reserved for a particular fluid actuator (FIG. 1, 102). Within this window, the corresponding fluid actuator (FIG. 1, 102) may or may not fire depending on the incoming signal with its respective firing instructions. That is, each actuation interval (416) represents an opportunity for an actuator within a primitive to fire.

The printing cycle (414) also includes a measurement interval (418) during which measurements occur. As described above, the length of each actuation interval (416) is determined based in part on a length of the measurement interval (418). An overly long measurement interval (418), as in the case when the measurement interval (418) is defined by the period of time needed to carry out a reference measurement following a nucleation event, the actuation intervals (416) may have a period that is selected such that the entire printing cycle (414) is a particular length. However, in this example, the period of the actuation intervals (416) may be such that print quality suffers. That is, if the actuation intervals (416) are too short, proper fluidic ejection may not occur.

Accordingly, by shortening the measurement interval (418) either by 1) taking reference measurements during non-nucleation events and/or 2) not taking peak measurements, the actuation intervals (416) could be lengthened to increase print quality or the length of the overall printing cycle (414) may be shortened, which equates to faster print speeds.

Figure 5:
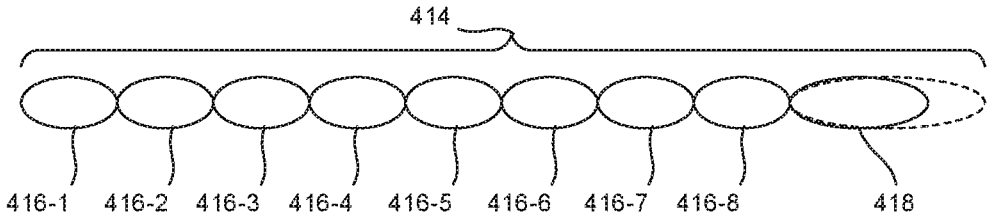
FIG. 5 is a diagram of the printing cycle for a one-step measurement, according to another example of the principles described herein.

FIG. 5 is a diagram of the printing cycle (414) for a one-step measurement, according to another example of the principles described herein. As described above, during a one-step measurement, a single printing cycle (414) is used. In the measurement interval (418) for this printing cycle, a single non-nucleation reference measurement is performed. Accordingly, as there is no need to wait for a drive bubble to form or collapse, the measurement interval (418) for a one-step measurement may be shorter than for example, a measurement interval (indicated in ghost) defined by the time needed to execute a reference measurement following a nucleation event.

Figure 6:
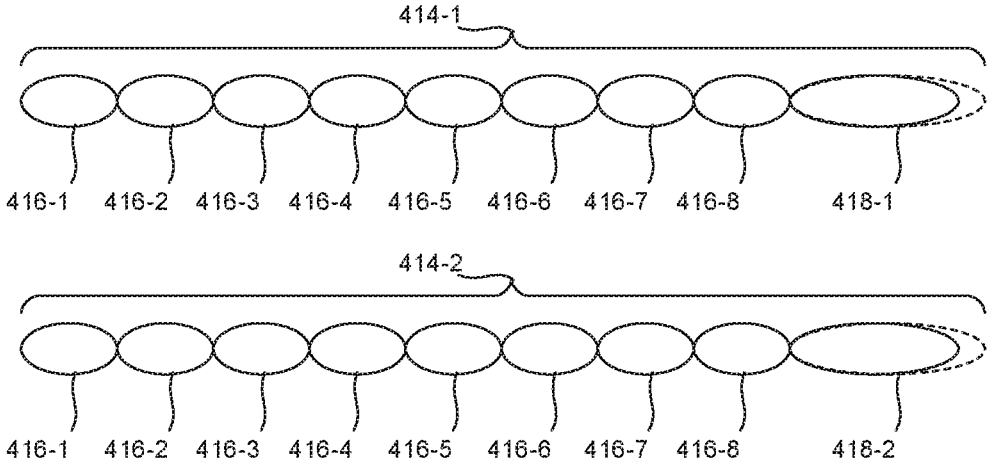
FIG. 6 is a diagram of the printing cycles for a two-step measurement, according to another example of the principles described herein.

FIG. 6 is a diagram of the printing cycle for a two-step measurement, according to an example of the principles described herein. As described above, during a two-step measurement, two printing cycles (414-1, 414-2) are used. In the measurement interval (418-1) for the first printing cycle (414-1), a nucleation peak measurement, or a non-nucleation reference measurement is performed. Accordingly, as there is no need to wait for a drive bubble to form, the measurement interval (418-1) for a two-step measurement may be shorter than for example, a measurement interval (indicated in ghost) defined by the time needed to execute a reference measurement following a nucleation event.

In the measurement interval (418-2) for the second printing cycle (414-2), the other of a nucleation peak measurement, or a non-nucleation reference measurement is performed.

As described above, because there is no need to wait for a drive bubble to form and collapse, the measurement intervals (418-1, 418-2) in a two-step measurement are shorter as compared to a measurement interval defined by the time needed to execute a reference measurement following a nucleation event. However, because there is still a time delay within the measurement intervals (418-1, 418-2) to account for signal propagation, drive bubble formation etc., the measurement intervals (418-1, 418-2) in a two-step measurement are not as short as is possible with the one-step measurement depicted in FIG. 5. However, the two-step measurement depicted in FIG. 6 may be more comprehensive and more accurate based on the additional data points associated with a nucleation peak measurement.

Figure 7:
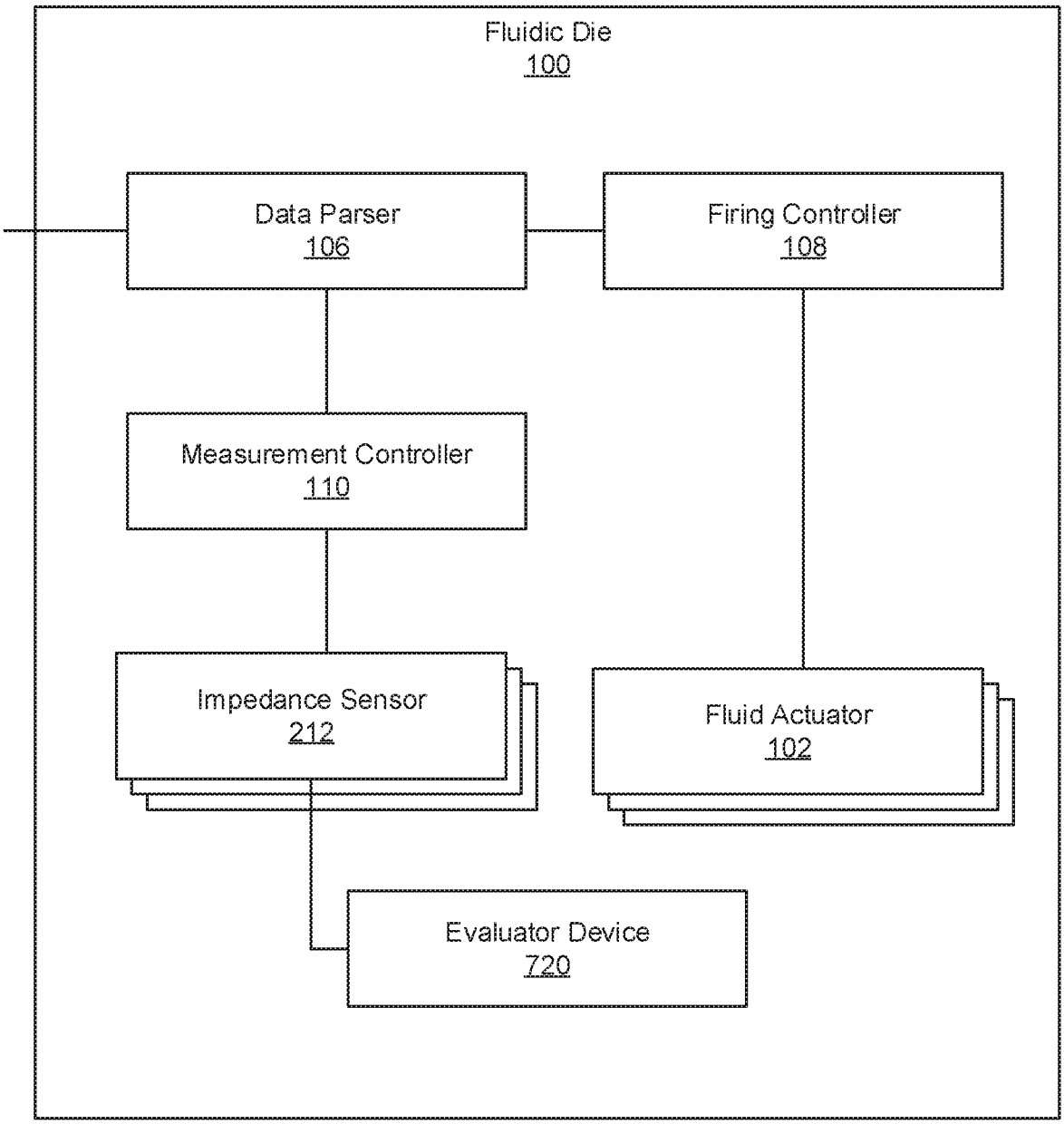
FIG. 7 is a block diagram of a fluidic die for performing fluid analysis with non-nucleation measurements, according to another example of the principles described herein.

FIG. 7 is a block diagram of a fluidic die (100) for performing fluid analysis with non-nucleation measurements, according to another example of the principles described herein. As in previous examples, the fluidic die (100) includes a data parser (106), firing controller (102), measurement controller (110), impedance sensors (212), and fluid actuators (102). In this example, the fluidic die (100) also includes an evaluator device (720). The evaluator device (720) determines the state of the selected fluid actuator (102) based on a profile for that fluid actuator (102).

The evaluator device (720) evaluates a state of any fluid actuator (102) and generates an output indicative of the fluid actuator (102) state. Specifically, the evaluator device (720) evaluates a fluid actuator (102) based at least on an output of the corresponding impedance sensor (212), which output is indicative of a sensed characteristic. While FIG. 7 depicts the evaluator device (720) as being located on the fluidic die (100) in some examples the evaluator device (72) may be located off-die. In this example, the measurement results are sent from the fluidic die (100) to a system controller which analyzes the results and determines fluid actuator (102) state.

As a specific example, a voltage difference is calculated between a peak measurement and a reference measurement or a profile generated based on the voltage differences and raw measurements. A voltage difference that is lower than a threshold may indicate improper bubble formation and collapse. Accordingly, a voltage difference greater than the threshold may indicate proper bubble formation and collapse. While a specific relationship, i.e., low voltage difference indicating improper bubble formation, high voltage difference indicating proper bubble formation, has been described, any desired relationship can be implemented in accordance with the principles described herein.

Figure 8:
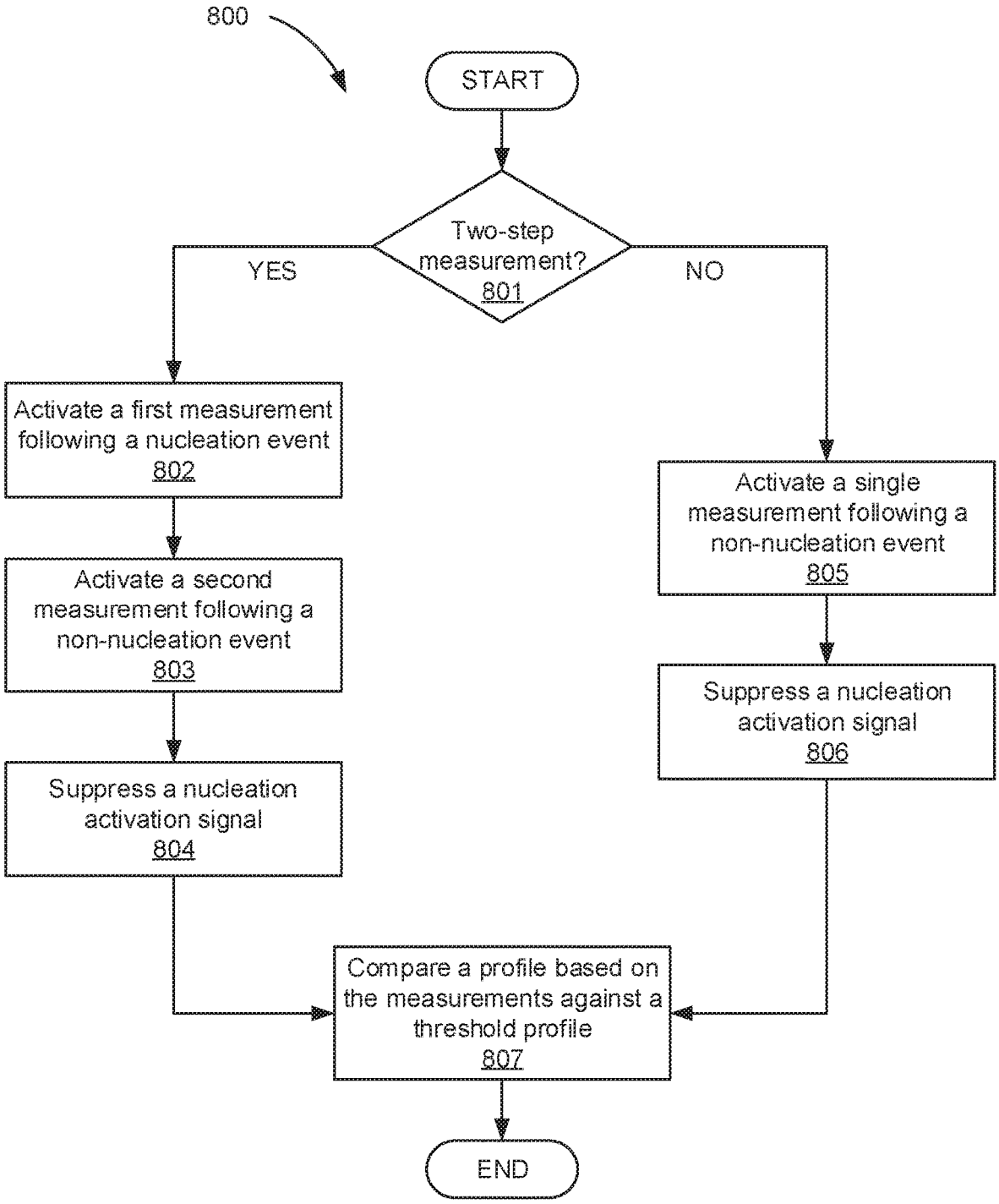
FIG. 8 is a flow chart of a method for performing fluid analysis with non-nucleation measurements, according to an example of the principles described herein.

FIG. 8 is a flow chart of a method (300) for performing fluid analysis with non-nucleation measurements, according to an example of the principles described herein, According to the method (800), it is determined (block 801) whether to perform a two-step measurement or a one step-measurement. This may be performed as described above in connection with FIG. 3.

If a two-step measurement is to be performed (block 801, determination YES), a first measurement following a nucleation event is activated (block 802) as described above in connection with FIG. 3. Following this measurement, a second measurement following a non-nucleation event is activated (block 803). In some examples, when a non-nucleation event is indicated for a measurement interval, the method (800) includes suppressing (block 804) an activation signal. That is, a signal that would otherwise result in a nucleation, i.e., drive bubble formation, is suppressed (block 804).

If a one-step measurement is to be performed (block 801, determination NO), a single measurement following a non-nucleation event is activated (block 805). In some examples, when a non-nucleation event is indicated for a measurement interval, the method (800) includes suppressing (block 806) an activation signal. That is, a signal that would otherwise result in a nucleation, i.e., drive bubble formation; is suppressed (block 806). In either case, a state of the selected fluid actuator (FIG. 1, 102) is determined by comparing (block 807) a profile based on the measurements against a threshold profile. That is; for a two-step measurement a profile that includes the peak measurement and reference measurement is generated and compared against a profile that has corresponding peak and reference thresholds. Similarly, for a one-step measurement, a profile that includes just a reference measurement is generated and compared against a profile that has just a reference threshold. Based on the comparison (block 807) results an output is generated from which subsequent remedial actions can be based, if needed.

In one example, using such a fluidic die 1) allows for actuator evaluation; 2) increases printing speed when actuator measurements are inserted into a printing cycle; 3) reduces the constraints imposed on measurement intervals and actuation intervals within a printing cycle thus improving image quality; and 4) reduces the number of unwanted fluidic ejection events thus conserving fluid.

What is claimed is:

1. A fluidic die, comprising:

an array of fluid actuators grouped into primitives, each actuator being disposed in a fluid chamber;

an array of fluid sensors, each fluid sensor disposed within a fluid chamber to determine a characteristic within the fluid chamber;

a data parser to extract, from an incoming signal, firing instructions and measurement instructions for the fluidic die, wherein the measurement instructions indicate at least one of a peak measurement during a nucleation event and a reference measurement during a non-nucleation event;

a firing controller to generate firing signals based on the firing instructions; and a measurement controller to activate, during a measurement interval of a printing cycle for the primitive, a measurement for a selected actuator based on the measurement instructions.

2. The fluidic die of claim 1, wherein the printing cycle includes the actuation interval for each fluid actuator in the primitive and the measurement interval.

3. The fluidic die of claim 2, wherein a length of each actuation interval is selected based on a length of the measurement interval and a desired printing cycle length.

4. The fluidic die of claim 1, wherein:

the measurement instructions indicate the reference measurement;

the firing instructions indicate a non-nucleation event; and the measurement controller activates a measurement for the selected actuator at a predetermined time within the measurement interval following the non-nucleation event.

5. The fluidic die of claim 4, wherein the reference measurement immediately follows the non-nucleation event.

6. The fluidic die of claim 1, wherein:

during one printing cycle:

the measurement instructions indicate the peak measurement;

the firing instructions indicate a nucleation event for the measurement interval; and the measurement controller activates a first measurement for the selected actuator at a predetermined time within the measurement interval following the nucleation event; and during another printing cycle:

the measurement instructions indicate a reference measurement;

the firing instructions indicate a non-nucleation event for the measurement interval; and the measurement controller activates a second measurement for the selected actuator at the predetermined time within the measurement interval following the non-nucleation event.

7. The fluidic die of claim 6, wherein the predetermined time comprises a delay within the measurement interval.

8. The fluidic die of claim 7, wherein the delay coincides with a period when a greatest impedance within the fluid chamber is expected.

9. The fluidic die of claim 1, wherein the measurement controller is to respond to a two-step measurement instruction in the measurement instructions extracted by the data parser by:

activating a first measurement for a selected actuator at a predetermined time within a measurement interval of a first printing cycle for a corresponding primitive, which first measurement follows a nucleation event; and activating a second measurement for the selected actuator at the predetermined time within a measurement interval of a second printing cycle for the primitive, which second measurement follows a non-nucleation event.

10. The fluidic die of claim 9, wherein the firing controller is to:

pass a nucleation activation signal to generate the nucleation event; and pass a non-nucleation activation signal, which provides insufficient energy to generate a nucleation event so as to provide the non-nucleation event for the measurement controller.

11. The fluidic die of claim 1, the measurement controller to respond to a one-step measurement instruction in the measurement instructions extracted by the data parser by activating a single measurement for a selected actuator within a measurement interval of a first printing cycle for a corresponding primitive, which one-step measurement immediately follows a non-nucleation event.

12. The fluidic die of claim 11, wherein the firing controller is to pass a non-nucleation activation signal to the selected actuator, which provides insufficient energy to generate a nucleation event, so as to provide the non-nucleation event for the measurement controller.

13. The fluidic die of claim 1, wherein the array of fluid sensors comprises impedance sensors.

14. A fluidic die, comprising:

an array of fluid actuators grouped into primitives, each actuator being disposed in a fluid chamber;

an array of impedance sensors, each impedance sensor disposed within a fluid chamber to determine an impedance within the fluid chamber;

a data parser to extract, from an incoming signal, firing instructions and measurement instructions for the fluidic die, wherein the measurement instructions indicate at least one of a peak measurement during a nucleation event and a reference measurement during a non-nucleation event;

a firing controller to generate firing signals based on the firing instructions; and a measurement controller to:

for a two-step measurement:

activate a first impedance measurement for a selected actuator at a predetermined time within a measurement interval of a first printing cycle for the primitive, which first impedance measurement follows a nucleation event; and activate a second impedance measurement for the selected actuator at the predetermined time within a measurement interval of a second printing cycle for the primitive, which second impedance measurement follows a non-nucleation event; and for a one-step measurement:

activate a single impedance measurement for the selected actuator within the measurement interval of the first printing cycle for the primitive, which one-step impedance measurement immediately follows a non-nucleation event.

15. The fluidic die of claim 14, further comprising an evaluator device to determine a state of the selected actuator based on a profile that includes one or more of the respective impedance measurements.

16. The fluidic die of claim 14, wherein the firing controller is to:

pass a nucleation activation signal to generate the nucleation event; and pass a non-nucleation activation signal, which provides insufficient energy to generate the nucleation event.

17. A method comprising:

determining which of a two-step measurement and a one-step measurement to execute;

for a two-step measurement:

activating a first measurement for a selected actuator at a predetermined time within a measurement interval of a first printing cycle for the primitive, which first measurement follows a nucleation event; and activating a second measurement for the selected actuator at the predetermined time within a measurement interval of a second printing cycle for the primitive, which second measurement follows a non-nucleation event; and for a one-step measurement:

activating a single measurement for the selected actuator within the measurement interval of the first printing cycle for the primitive, which one-step measurement immediately follows a non-nucleation event; and determining a state of the selected actuator based on a profile that includes the respective measurements.

18. The method of claim 17, further comprising, suppressing an activation signal during a non-nucleation event.

19. The method of claim 17, wherein determining a state of the selected actuator comprises comparing the profile based on the measurements against a threshold profile.

20. The method of claim 17, wherein determining which of a two-step measurement and a one-step measurement to execute is based on an activity of the fluidic die.

* * * * *